US007024992B2

(12) United States Patent
Johnson

(10) Patent No.: US 7,024,992 B2
(45) Date of Patent: Apr. 11, 2006

(54) MOBILE SIDE-LOAD METAL CRUSHING DEVICE

(76) Inventor: Robert M. Johnson, 5852 County Road 44, South Haven, MN (US) 55382

( * ) Notice: Subject to any disclaimer, the term of this patent is extended or adjusted under 35 U.S.C. 154(b) by 197 days.

(21) Appl. No.: 10/222,146

(22) Filed: Aug. 16, 2002

(65) Prior Publication Data

US 2004/0031403 A1 Feb. 19, 2004

(51) Int. Cl.
*B30B 1/08* (2006.01)

(52) U.S. Cl. ..... 100/901; 100/100; 100/226; 100/232; 100/264

(58) Field of Classification Search ..... 100/42.01, 100/901, 226, 232, 233, 269, 100, 269.01
See application file for complete search history.

(56) References Cited

U.S. PATENT DOCUMENTS

| | | | | | |
|---|---|---|---|---|---|
| 3,170,389 | A | * | 2/1965 | Parks | 100/192 |
| 3,965,812 | A | * | 6/1976 | Oberg | 100/39 |
| 4,018,169 | A | | 4/1977 | Schmalz | |
| 4,188,876 | A | * | 2/1980 | Graves | 100/232 |
| 4,417,510 | A | | 11/1983 | Sharp | |
| 4,441,415 | A | | 4/1984 | Hawkins | |
| 4,442,766 | A | | 4/1984 | Hawkins | |
| 4,697,509 | A | | 10/1987 | LaBounty | |
| 5,655,443 | A | * | 8/1997 | Hall | 100/100 |

OTHER PUBLICATIONS

Author Unknown, "The E–Z Crusher", R.M. Johnson Co., http://www.ezcrusher.com/EZCrusher/crusher.html, at least as early as Aug. 16, 2002.
Author Unknown, "The E–Z Log Baler", R. M. Johnson Co., http://www.ezcrusher. com/EZCrusher/baler.html, at least as early as Aug. 16, 2002.
Author Unknown, "Colmar—Compactor, Model P4.260–P5.260", Colmar S.p.A., 6 pages; at least as early as Aug. 16, 2002.
Author Unknown, "500 Xtreme Car Logger", Al–jon, Inc., 1 page, at least as early as Aug. 16, 2002.
Author Unknown, "Aj–500 Car Logger", Al–jon, Inc., 1 page, at least as early as Aug. 16, 2002.
Author Unknown, "500Xtreme Car Logger—There is no Substitute for Iron", Al–jon, Inc. 2 pages, at least as early as Aug. 16, 2002.
AUthor Unknown, "5000 RB Portable Car Logger", Sierra, 4 pages, at least as early as Aug. 16, 2002.

* cited by examiner

*Primary Examiner*—Allen Ostrager
*Assistant Examiner*—Shelley Self
(74) *Attorney, Agent, or Firm*—Dorsey & Whitney LLP

(57) ABSTRACT

A mobile metal crushing system and a method for forming scrap metal bales by crushing automobiles and scrap metal latitudinally, vertically, and longitudinally. The crusher has a frame with wheels and a baling chamber with a bottom deck, a load door for latitudinal crushing, a crush plate for vertical crushing, and a wall. The wall has a plunger for longitudinal crushing.

19 Claims, 19 Drawing Sheets

MOBILE SIDE-LOAD METAL CRUSHING DEVICE

FIELD OF THE INVENTION

The present invention relates to a device and method for forming scrap metal bales by crushing automobiles and scrap metal. More specifically, the present invention relates to a device and method for forming scrap metal bales by crushing automobiles and scrap metal latitudinally, vertically and longitudinally.

BACKGROUND OF THE INVENTION

An increasingly strong demand for disparate scrap metal such as black sheet clips, loose steel, industrial skeleton sheets, trim stock, white goods galvanized sheet and clips, stainless steel sheets, aluminum sheet, and scrap metal from junked automobiles, has created a demand for mobile scrap metal crushers having efficiencies competitive with large centralized scrap metal crushing facilities.

A mobile crusher will usually have one of two crushing chamber configurations. The first configuration requires the crushing chamber be loaded through its top, typically necessitating the use of a crane. Whether the crane is mounted on the crusher or separate, a crane loading operation has the disadvantage that a crane must either be relocated once the scrap proximate to the crane has been exhausted or be fed by a more mobile piece of equipment like a front-end loader. Relocating the crane usually necessitates the relocation of the crusher, which takes valuable time.

The second configuration requires the crushing chamber be loaded through one of its sides, thereby facilitating the use of highly mobile loading equipment like front-end loaders, skidders, or forklifts. Loading a crusher with mobile loading equipment like front end loaders is advantageous because the crusher does not require relocation and a crane is not required.

To effectively compete with the large centralized crushing facilities, mobile crushers need to be capable of accepting one or more complete and entire junk automobiles per loading cycle. This requirement combined with the side loading configuration results in mobile crushers having hydraulic cylinders that protrude significantly above the crusher, preventing the crusher's transport along roads without lowering the hydraulic cylinders. In the past, the lowering and raising of hydraulic cylinders to allow transport and operation has been difficult and time consuming. Thus, there was a demand for a mobile sideload crusher that could quickly and conveniently convert from transportation mode to operation mode.

One crusher that attempted to meet this demand was the subject of U.S. Pat. No. 5,655,443, issued to Hall on Aug. 12, 1997. Hall discloses a mobile car crusher designed to reduce junk cars into slabs by simply crushing them vertically. A car crusher, like Hall, will reduce a full-size car to a slab having the following approximate dimensions: nine inches tall; eight feet wide and twenty feet long.

While the Hall crusher is adequate for reducing automobiles to slabs, it is less than adequate for the processing of loose scrap metal for two reasons. First, loading the Hall crusher with a sufficient charge of loose scrap metal will result in pieces of scrap spilling from the crushing chamber before the loading door of the Hall crusher can be completely closed. Second, simply crushing a charge of loose scrap metal results in a slab having poor structural integrity, such that the slab will have difficulty in staying together during handling and transport.

The scrap metal recycling industry is moving away from slabs in favor of bales. Approximate desired dimensions for a full size car that has been baled are: two feet tall; four feet wide and twelve feet long. Because the Hall crusher can only process metal scrap into slabs, the Hall crusher fails to address the recycling industry's preference for bales over slabs.

Consequently, there is a need in the art for a portable metal crusher capable of: (1) side loading by highly mobile loading equipment like front-end loaders, skidders, and forklifts; (2) convenient conversion between the transportation and operation modes; (3) processing loose scrap metal without excessive spilling of scrap from the crushing chamber before the loading door is fully closed; and (4) reducing both automobiles and charges of loose scrap metal to bales having structural integrity.

There is also a need in the art for a method of scrap metal processing that: (1) facilitates side loading by highly mobile loading equipment like front-end loaders, skidders, and forklifts; (2) is conveniently transportable; (3) deters loose pieces of scrap from spilling from the crushing chamber before the loading door is fully closed; and (4) is capable of reducing both automobiles and charges of loose scrap metal to bales having structural integrity.

BRIEF SUMMARY OF THE INVENTION

The present invention, in one embodiment, is a mobile metal crusher capable of forming scrap metal bales by crushing automobiles and scrap metal latitudinally, vertically, and longitudinally. The crusher has a frame with wheels, the wheels facilitating the transport of the crusher. The crusher also has a baling chamber that has a bottom deck, a load door, a crush plate, and a wall. The load door is pivotally connected to the bottom deck and is capable of crushing automobiles latitudinally as the door pivots from an open position to a closed position. The crush plate is located above the bottom deck and is capable of crushing automobiles vertically as the crush plate is displaced vertically within the baling chamber. The wall is rigidly connected to the bottom deck and has a plunger, the plunger being capable of crushing automobiles longitudinally as the plunger is displaced horizontally within the baling chamber.

Another embodiment of the present invention is a method of forming scrap metal bales by crushing automobiles and scrap metal latitudinally, vertically, and longitudinally. First, the baling chamber is loaded with the metal to be crushed. The load door is then pivoted up to its fully closed position to crush the metal latitudinally. The crush plate is then vertically displaced within the baling chamber to crush the metal vertically. Finally, the plunger is horizontally displaced within the baling chamber to crush the metal longitudinally.

Another embodiment of the present invention is a method of preparing a mobile metal crusher for transportation. First, a piston is extended from a crush plate cylinder to lower a crush plate to its fully down position within a baling chamber. A securing end on a top deck is then disconnected from a peak on the wall. The piston is then retracted into the crush plate cylinder to lower the top deck and the crush plate cylinder into the baling chamber.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
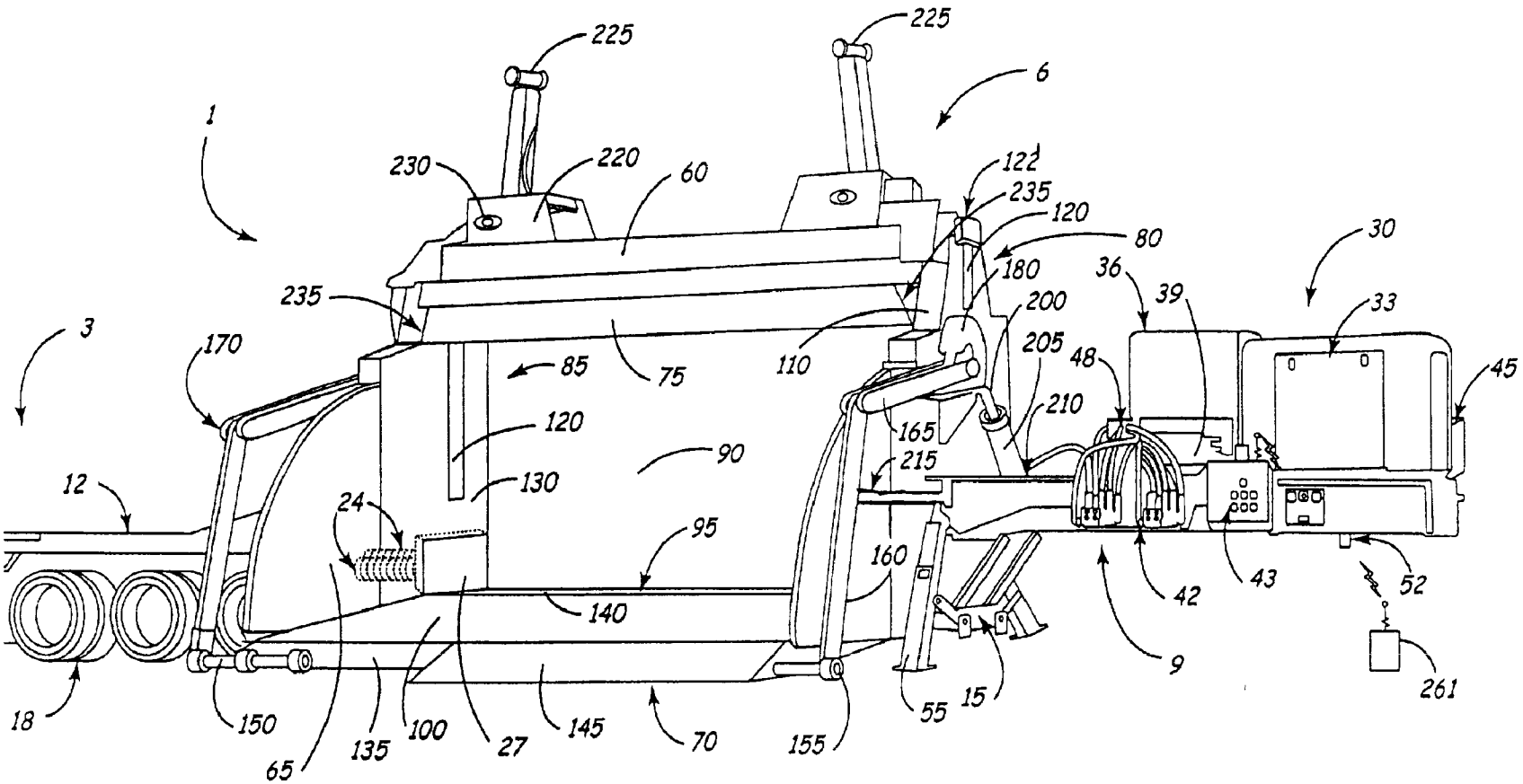
FIG. 1 is a side perspective view of the portable metal crusher in operation mode, according to one embodiment of the present invention, with the load door in the fully down position, the side shields unfolded to their fully open position, the stabilizers fully extended, the top deck secured to the fore and aft wall peaks, and the plunger and crush plate fully retracted.

FIG. 1 shows a side perspective view of a portable metal crusher 1 in operation mode. The portable metal crusher 1 includes a semi-trailer 3 and a baler 6. The semi-trailer 3 has a gooseneck 9, a rear frame 12, and a belly section 15, which supports the baler 6. While the semi-trailer 3 portrayed in FIG. 1 is a low-boy type, it should be noted that other types of semi-trailers may be utilized.

Figure 2:
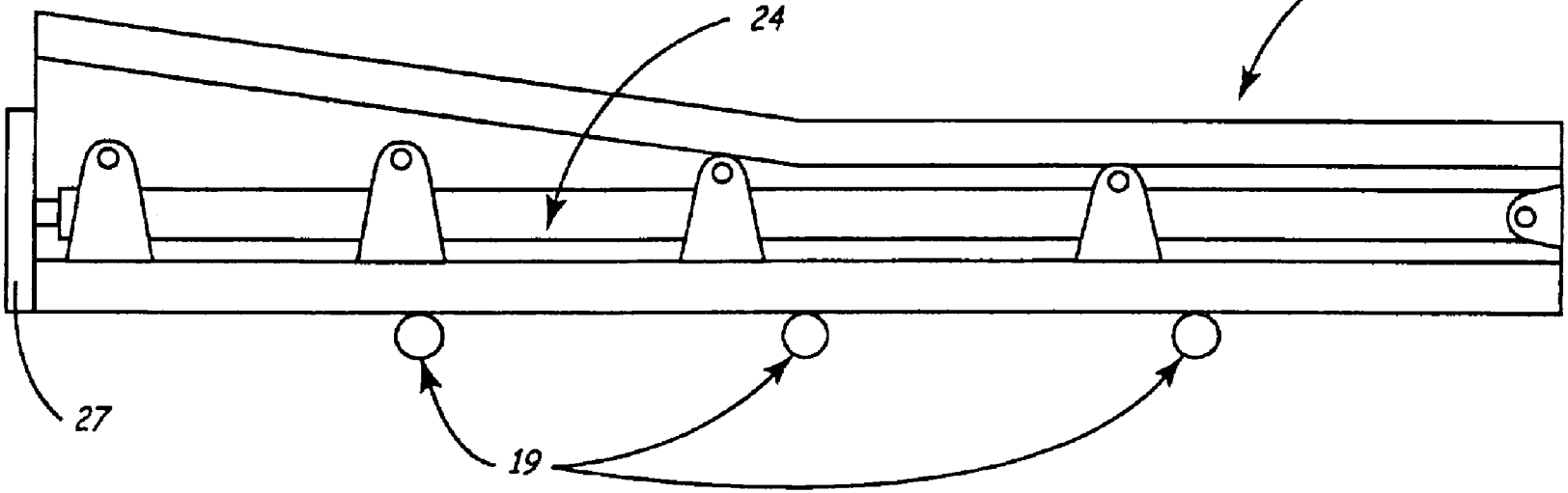
FIG. 2 is a side elevation view of the rear frame portion of the semi-trailer and the plunger cylinders contained therein.

As shown in FIGS. 1 and 2, the rear frame 12 is supported above the ground by wheels 18 mounted on axles 19. Located within the rear frame 12, aft of the baler 6 and above the axles 19, are one or more plunger cylinders 24 for actuating a plunger 27. Alternatively, the one or more plunger cylinders 24 may be located aft of the baler 6 and fore of the axles 19.

As indicated in FIG. 1, a power plant 30 for powering and controlling the hydraulics of the portable metal crusher 1 is located on the gooseneck 9 of the semi-trailer 3. The power plant 30 has an engine 33, an oil reservoir 36, a hydraulic pump 39, a control valve manifold 42, a control panel 43, a fuel tank 45, and multiple hydraulic hoses 48 that run from the control valve manifold 42 to the various hydraulic cylinders of the portable metal crusher 1. Connected to the bottom of the gooseneck 9 is a kingpin 52 for connecting the semi-trailer 3 to a semi-tractor's fifth wheel (not shown) for transporting the portable metal crusher 1.

Four stabilizers 55 for stabilizing the portable metal crusher 1 during operation mode, as shown in FIG. 1, are connected to the semi-trailer 3. Two stabilizers 55 are located on each side of the semi-trailer 3, one being connected to the semi-trailer near the junction between the gooseneck 9 and the baler 6 and the other being connected to the semi-trailer 3 near the junction between the rear frame 12 and the baler 6. The stabilizers 55 are hydraulically extended and retracted. Prior to operation of the portable metal crusher 1, the operator will extend the stabilizers 55 to stabilize the crusher 1. Prior to transporting the portable metal crusher 1, the operator will fully retract the stabilizers 55.

The baler 6 has a top deck 60, a pair of side shields 65, and a baling chamber 70, wherein loose scrap metal or auto bodies are loaded for crushing into bales of scrap metal. The baling chamber 70 includes a crush plate 75, a fore wall 80, an aft wall 85, a back wall 90, a bottom deck 95, and a load door 100. The crush plate 75 is vertically displaceable within the baling chamber 70.

Figure 3:
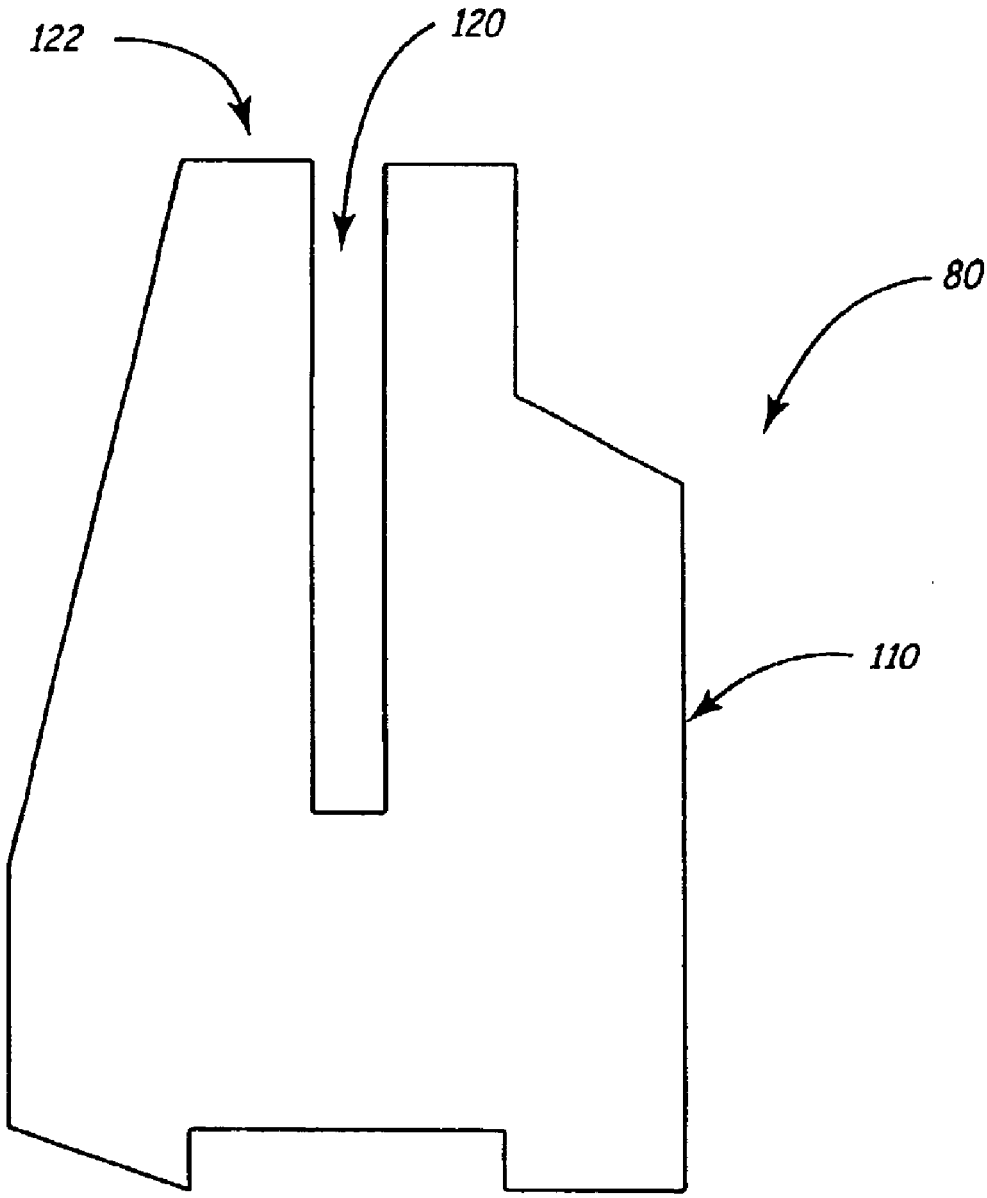
FIG. 3 is an elevation view of the fore wall from a point on the portable metal crusher just aft of the fore wall.
Figure 4:
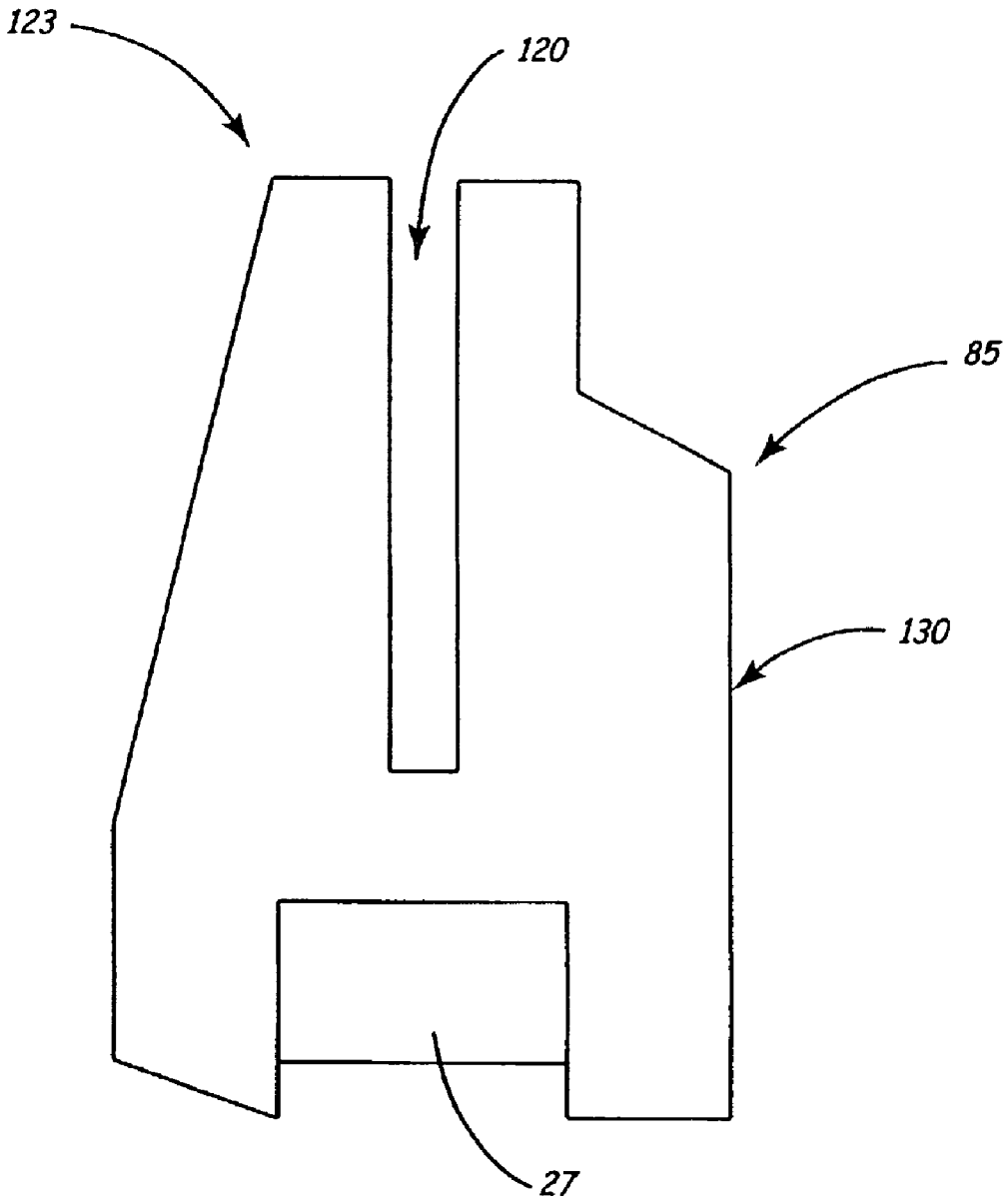
FIG. 4 is an elevation view of the aft wall from a point on the portable metal crusher just aft of the aft wall.

The fore wall 80 and the aft wall 85 are rigidly connected to the back wall 90, thereby forming three sides of the baling chamber 70. The fore wall 80, the aft wall 85, and the back wall 90 are rigidly connected to the bottom deck 95. As best shown in FIG. 3, the fore wall 80 has a fore guide plate 110 that has a guide slot 120 and a fore wall peak 122. As best shown in FIG. 4, the aft wall 85 has a plunger 27 and an aft guide plate 130 that has a guide slot 120 and an aft wall peak 123. The plunger 27 is horizontally displaceable within the baling chamber 70.

As shown in FIG. 1, the load door 100 has a top edge 135 and a bottom edge 140, the bottom edge 140 being pivotally connected by a system of hinges 141 to the bottom deck 95 and its supporting belly section 15 of the semi-trailer 3. A ramp 145 is removably connected to the top edge 135 of the load door 100. A shaft 150 is rigidly connected to each corner of the top edge 135 of the load door 100. Each shaft end 155 is pivotally connected to the first end of a lower arm 160. The second end of each lower arm 160 is pivotally connected to a first end of an upper arm 165, forming an elbow 170.

Figure 5:
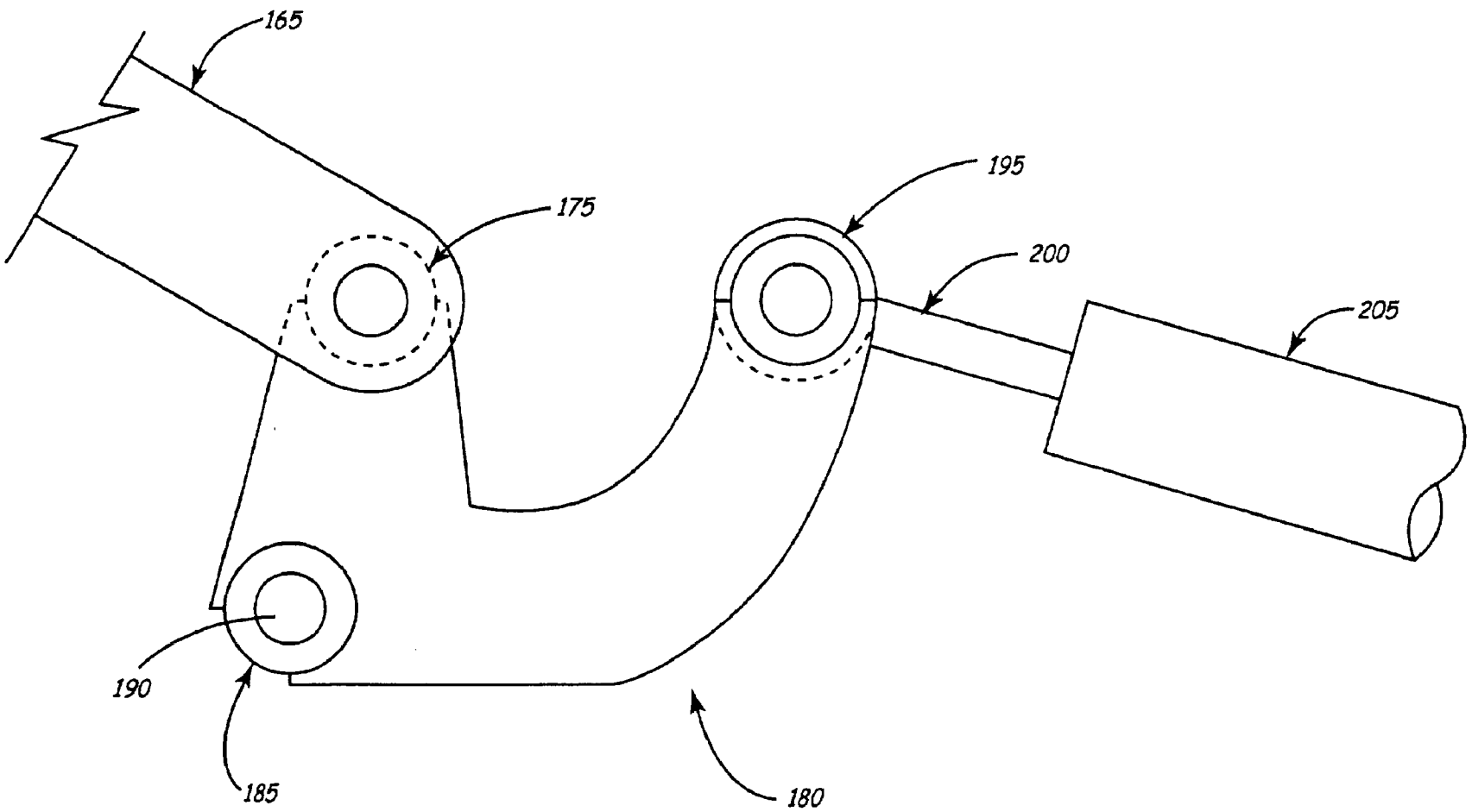
FIG. 5 is an elevation view of an arm rotator connected to an upper arm, a piston shaft end, and a pivot shaft.

As shown in the combination of FIGS. 1 and 5, the second end of each upper arm 165 is pivotally connected to the arm eye 175 of an arm rotator 180. Each arm rotator 180 is pivotally connected about its fulcrum 185 to a pivot shaft 190 protruding from a wall 80, 85 of the baler 6. Each lever eye 195 of each arm rotator 180 is pivotally connected to a piston shaft end 200 of a door cylinder 205, the cylinder end 210 of each door cylinder 205 being connected to the semi-trailer 3 near its intersection with the walls 80, 85 of the baler 6.

Each door cylinder 205 causes its respective arm rotator 180 to pivot about its fulcrum 185 thereby causing the arms 160, 165 to extend or retract. When the arms 160, 165 extend, the load door 100 will pivot about the system of hinges 141 connected to the bottom edge 140 to an open position as reflected in FIG. 1. When the load door 100 is in its fully open position, as reflected in FIG. 1, the arms 160, 165 will still not be in a fully extended, linear configuration but will form an angle at the elbow 170 that is slightly greater than 90 degrees. Not fully extending the arms 160, 165 to a straight linear configuration provides increased mechanical leverage for the arms when closing the load door 100.

Figure 6:
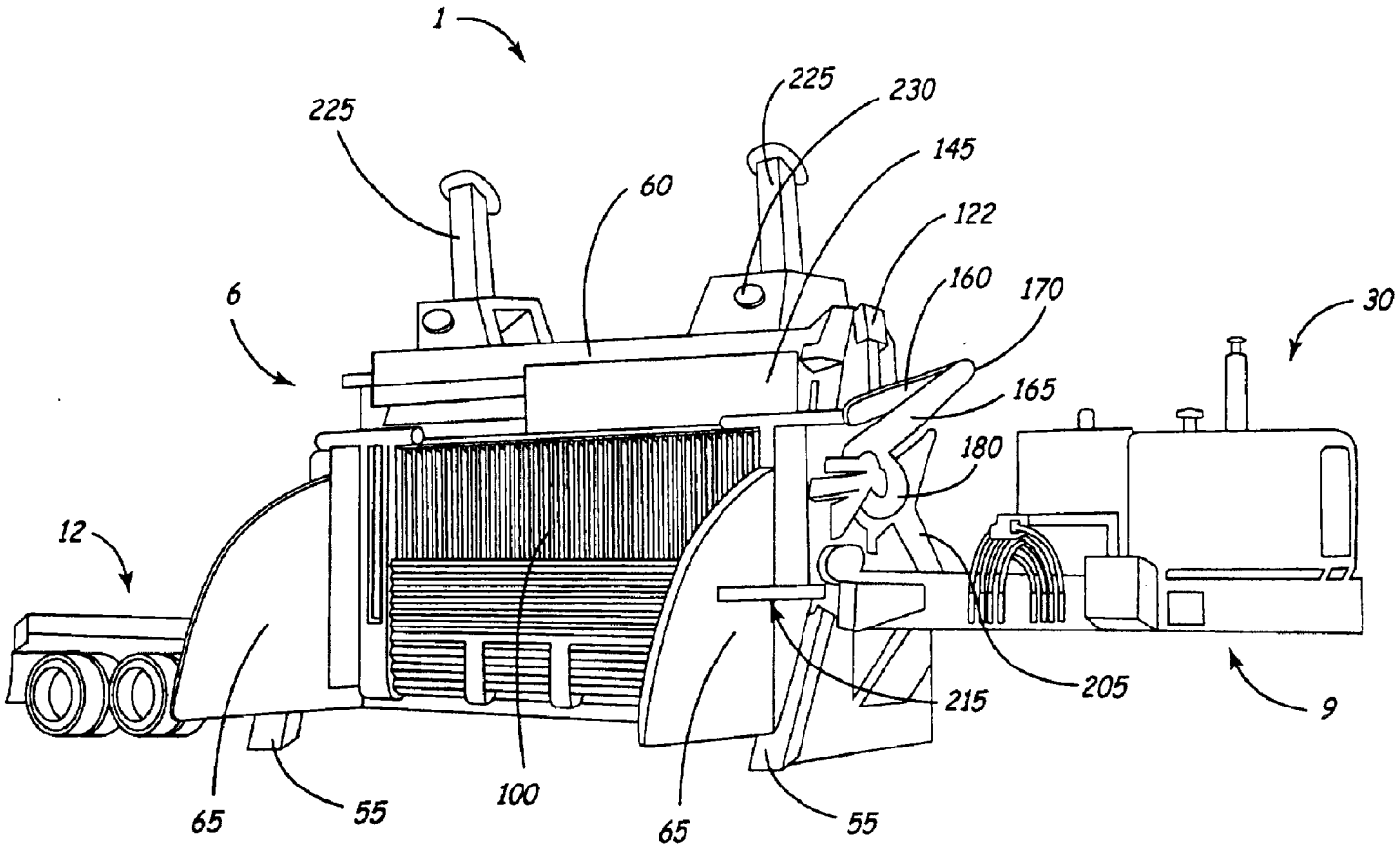
FIG. 6 is a side perspective view of the portable metal crusher in operation mode, according to one embodiment of the present invention, with the load door in the fully up position, the side shields unfolded to their fully open position, the stabilizers fully extended, and the top deck secured to the fore and aft wall peaks.

When the arms 160, 165 retract, the load door 100 will pivot about the system of hinges 141 connected to the bottom edge 140 to a closed position as reflected in FIG. 6. The arm rotators 180 are mechanically advantageous in that their lever action increases the closing force of the load door 100, allowing the load door 100 to squeeze scrap metal into the baling chamber 70. Once the load door 100 reaches its fully closed position, the arms 160, 165 will have folded into a position that is self-locking as illustrated in FIG. 6.

FIG. 1 shows that a side shield 65 is pivotally attached to the loading side of each fore wall 80 and aft wall 85. As reflected in FIG. 7, when the portable metal crusher 1 is in transportation mode, the side shields 65 are folded in against the load door 100, which is in its fully up position.

As reflected in FIG. 1, when the portable metal crusher 1 is in operation mode, the side shields 65 will be unfolded to their full open positions (i.e., until the side shields 65 are perpendicular to the long axis of the semi-trailer 3), thereby allowing sufficient clearance for the load door 100 to be lowered into its loading position. The side shields 65 are locked in their full open positions by attachment rods 215, which run from connections on the side shields 65 to connections on the semi-trailer 3 or the baler 6.

Figure 8:
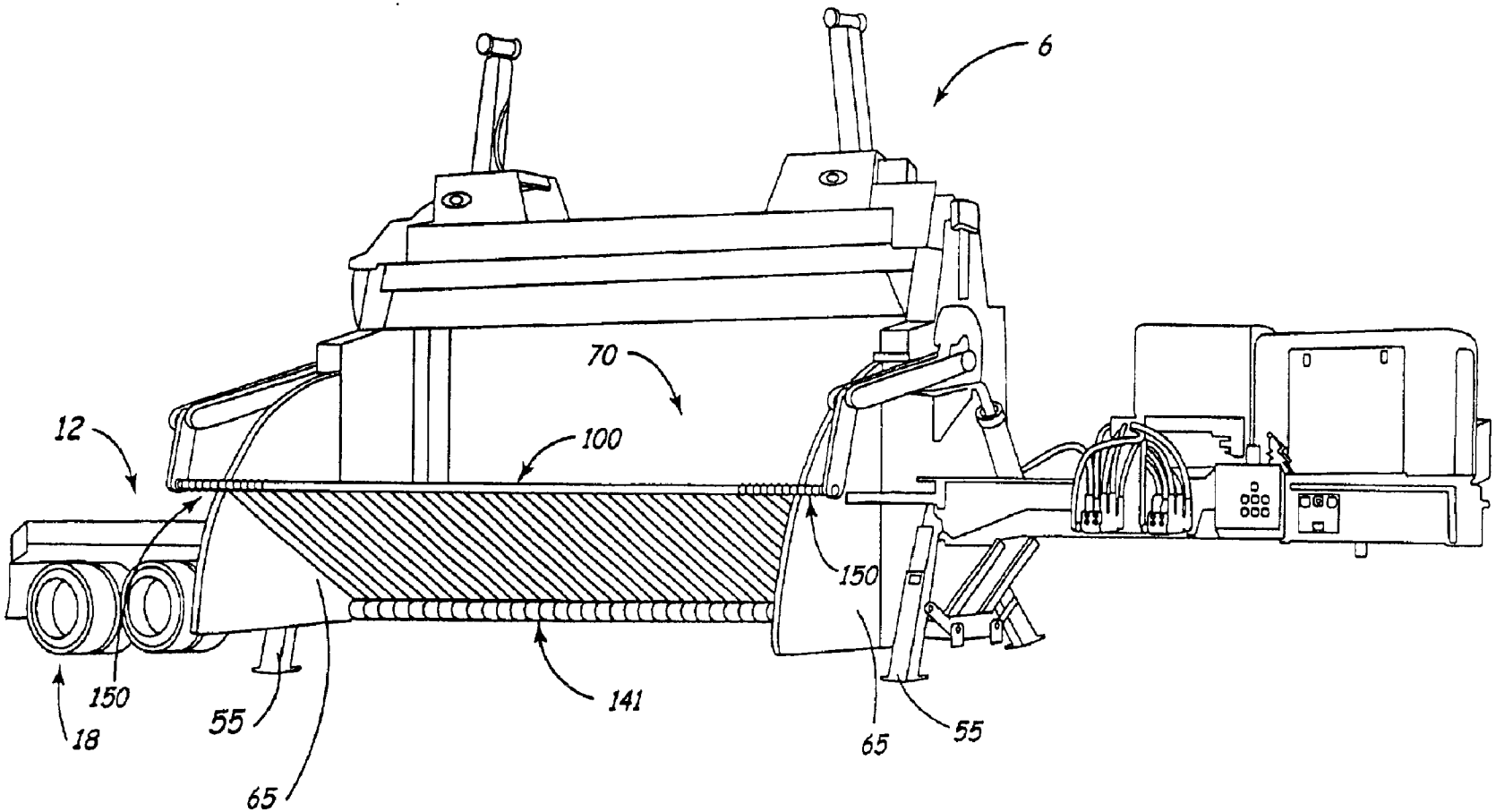
FIG. 8 is a side perspective view of the portable metal crusher in operational mode with the load door positioned at an angle intermediate between the fully up and down positions, forming with the side shields a hopper in which to receive loose scrap.

In operation mode, the side shields 65 shield an operator standing at the control valve manifold 42 from debris that may emanate from the baling chamber 70 during loading, crushing or unloading. Since the load door 100 is positionable at any angle between the fully down and fully up positions, and since the side shields 65 are continuous along the full range of load door 100 positions, the combination of the load door 100 and side shields 65 form an adjustable hopper, as shown for example in FIG. 8. This hopper aspect of the portable metal crusher 1 is advantageous in that it prevents pieces of loose scrap metal from spilling out of the baling chamber 70 during loading of the baling chamber 70 or closing of the load door 100. The hopper feature is also advantageous because it allows the portable metal crusher 1 to be loaded by a crane, in addition to side loading equipment like front end loaders, forklifts and skidders.

As can be seen in FIG. 1, the load door 100 in its fully down position lays nearly flat on the ground. This feature allows the upper surface of the load door 100 and the bottom deck 95 to be relatively parallel and to form an essentially level continuous surface. This continuous level surface is advantageous because it allows a front end loader to simply approach and remove a bale from the baling chamber 70 with the loader arms low and the tines of the loader head relatively level, as opposed to having to raise and extend the loader's arms and tilt the loader's head in order to pick up the bale. The continuous level surface makes bale removal easier and safer for the loader operator, keeping the bale's mass as low and close to the loader's center of gravity as possible during the bale's removal from the baling chamber 70.

Figure 9:
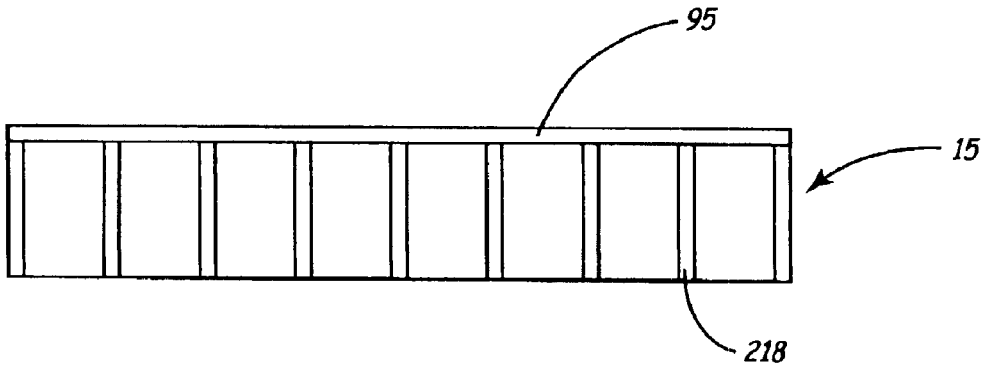
FIG. 9 is a cross sectional view of the bottom deck, illustrating the low-profile structural members making up the belly section of the semi-trailer.

As illustrated in FIG. 1, the ability of the load door 100 to lay nearly flat on the ground is a result of the bottom deck 95 being in close proximity to the ground. As shown in FIG. 1 and 9, the belly section 15 of the semi-trailer 3 provides the structural support for the bottom deck 95. Because the belly section 15 is the low part of the low-boy type semi-trailer 3 and is constructed of structural members 218 having relatively small vertical cross-sectional dimensions, the bottom deck 95 is located in close proximity to the ground level.

As shown in FIG. 1, a top deck 60 has two deck cylinder mounts 220 and two crush plate cylinders 225. A cylinder mount pin 230 secures each crush plate cylinder 225 to its respective deck cylinder mount 220. Each crush plate cylinder 225 is independently operable and the piston shaft end 228 of each vertical piston 229 (see FIGS. 13 and 18) emanating from each crush plate cylinder 225 is pivotally connected to the top of the crush plate 75, thereby allowing one end of the crush plate 75 to be extended down below the other end for selective leverage tilting of the crush plate 75. To facilitate selective leverage tilting of the crush plate 75, the crush plate ends 235 are sloped towards the center of the crush plate 75, thereby providing the necessary clearance between walls 80, 85 when the crush plate 75 is in a tilted position (see FIGS. 1 and 14).

Figure 10:
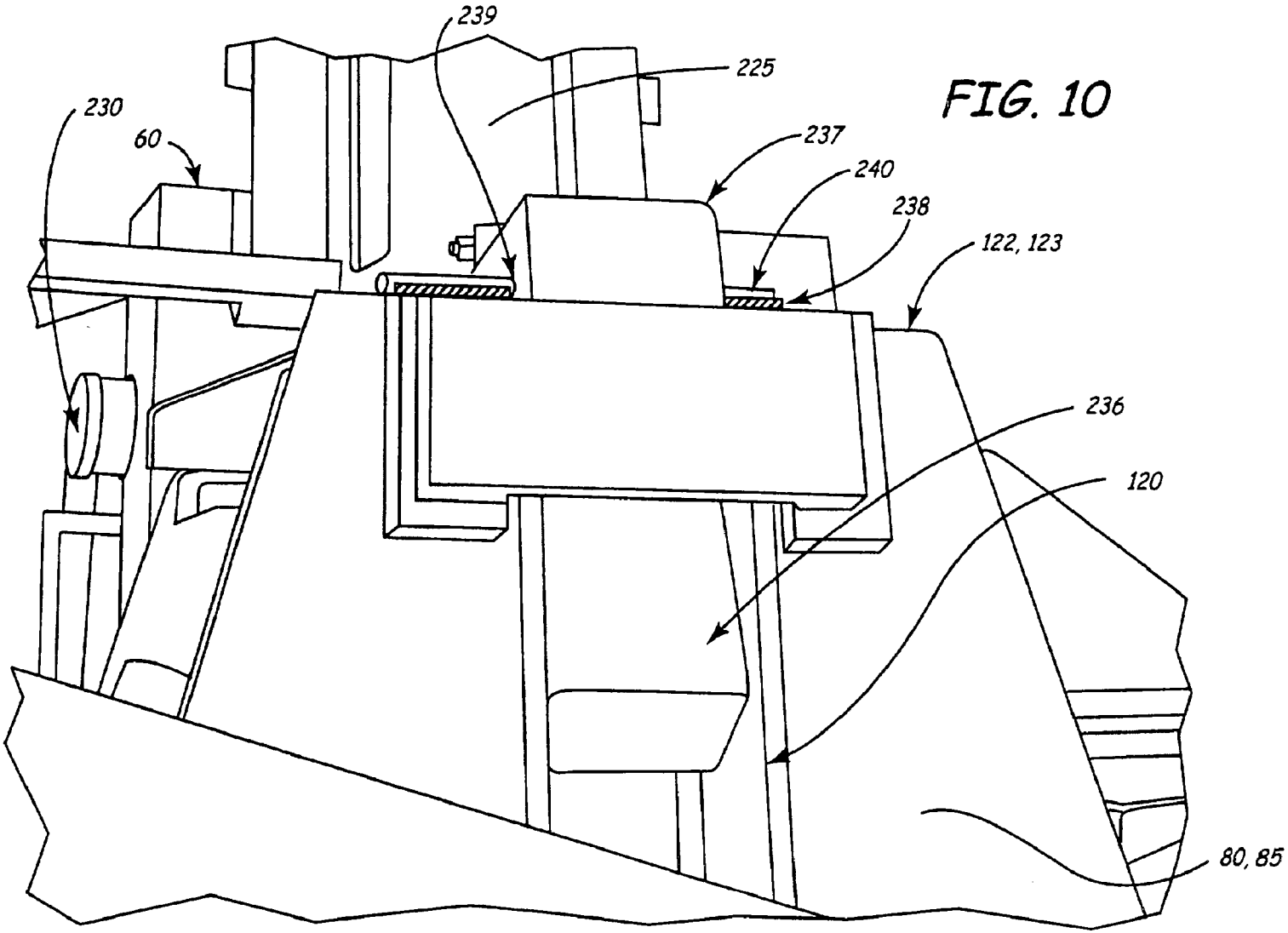
FIG. 10 is an end perspective view of a wall peak illustrating the relationship between the guide slot and the goosenecks of the top deck and crush plate.
Figure 14:
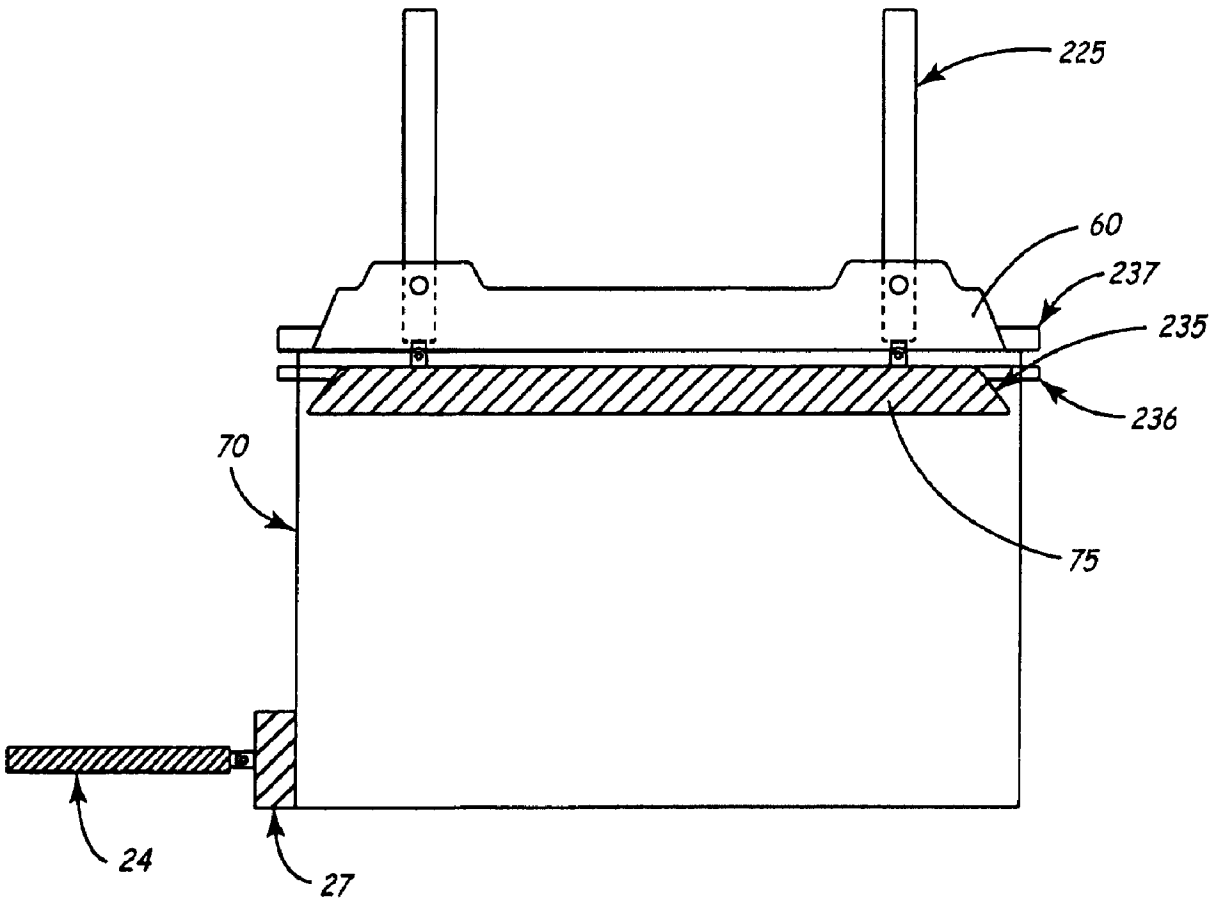
FIG. 14 a simplified elevation side view of the baler portion of FIG. 13 where the crush plate has been fully retracted up and the support stands have been removed.

As reflected in FIGS. 10 and 14, a crush plate gooseneck 236 extends from each crush plate end 235 and is slidably engaged within the guide slot 120 in the fore and aft guide plates 110, 130. The interaction of the crush plate goosenecks 236 with the guide slots 120 prevents the crush plate 75 from being displaced horizontally as the crush plate 75 is displaced vertically by the crush plate cylinders 225.

Figure 11:
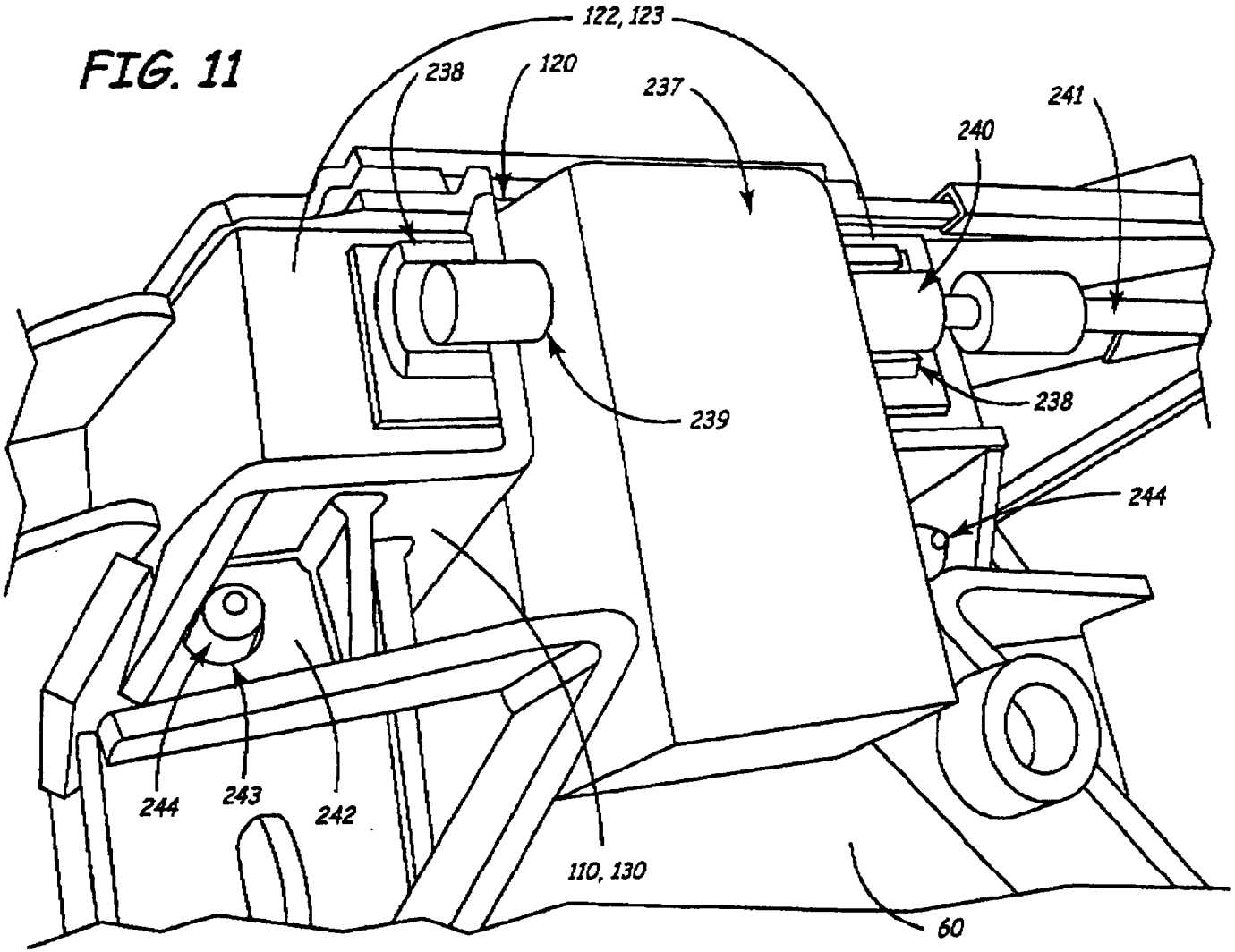
FIG. 11 is a top view of a top deck gooseneck secured by a peak pin and multiple guide pins to the top of a wall peak.

As shown in FIGS. 10, 11 and 14, a top deck gooseneck 237 extends from the fore and aft ends of the top deck 60 and is slidably engaged within the guide slot 120 in the fore and aft guide plates 110, 130. The interaction of the top deck goosenecks 237 with the guide slots 120 prevents the top deck 60 from being displaced horizontally as the top deck 60 is displaced vertically by the crush plate cylinders 225.

As illustrated in FIGS. 10 and 11, each wall peak 122, 123 has a pair of saddles 238 located on its top, a single saddle 238 being located adjacent to each side of the guide slot 120. A pin hole 239 penetrates each top deck gooseneck 237. When the top deck 60 is in its fully up, operational position (as reflected in FIG. 1), a peak pin 240 is inserted in the pin hole 239 and rests in the saddles 238. The peak pin 240 then supports the top deck 60 from the wall peaks 122, 123. A push pin 241 may be used to insert the peak pin 240 into the pin hole 239. The push pin 241 may be operated by hand or may be mechanized via mechanical or hydraulic means.

As indicated in FIG. 11, horizontal plates 242 extend horizontally from the guide plates 110, 130. A guide hole 243 penetrates each horizontal plate 242. Guide pins 244, which extend up from the top deck 60, protrude up through the guide holes 243 when the top deck 60 is in its fully up, operational position (as reflected in FIG. 1). When the guide pins 244 are engaged in the guide holes 243, the top of the top deck 60 encounters the bottom of the horizontal plates 242, thereby preventing the top deck 60 from being displaced upwards by the crush plate cylinders 225 during crushing operations.

Figure 7:
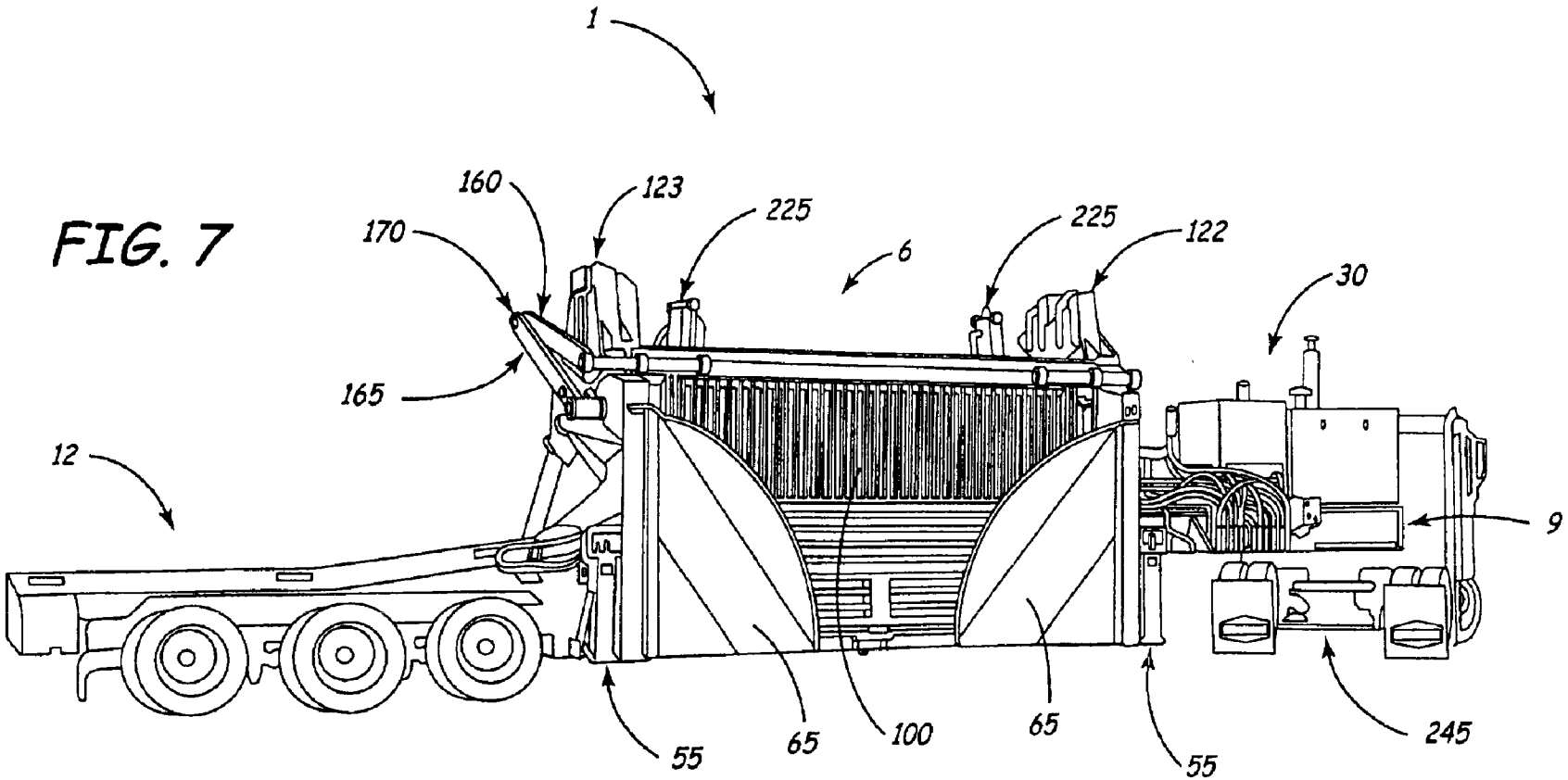
FIG. 7 is a side perspective view of the portable metal crusher in transportation mode with the load door in the fully up position, the side shields folded against the load door, the stabilizers fully retracted, the top deck recessed within the baling chamber, and the portable metal crusher connected to a semi-tractor.

To illustrate the transformation of the portable metal crusher 1 from transport mode to operation mode, FIGS. 1, 7, 10, 11, 12, 13 and 14 will be addressed. As illustrated in FIG. 7, the portable metal crusher 1 will be towed in transport mode to a metal salvage location by a semi-tractor 245 and positioned as desired.

Figure 12:
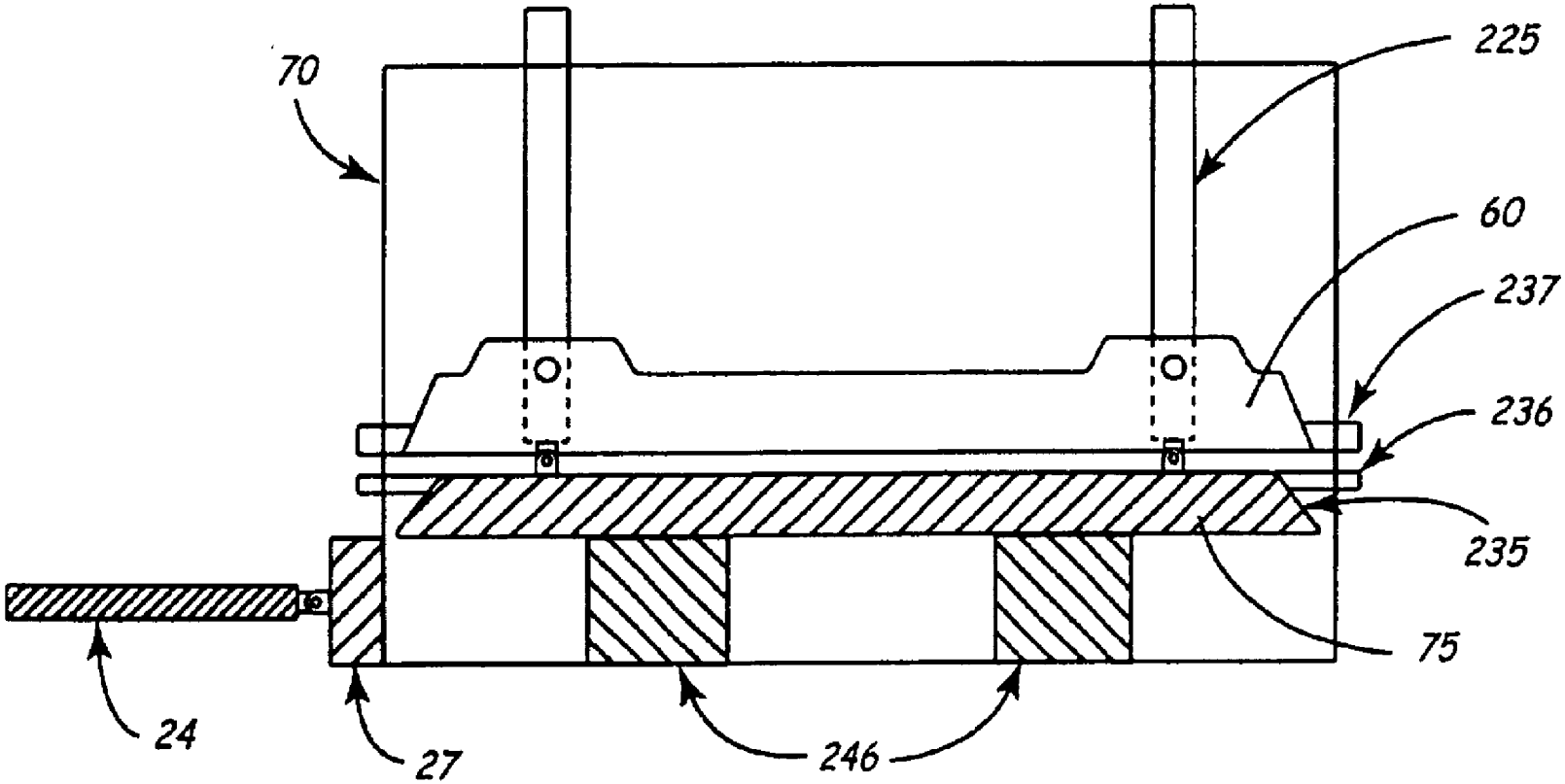
FIG. 12 is a simplified elevation side view of the baler portion of the portable metal crusher with the load door removed showing the top deck and crush plate resting on support stands when the portable metal crusher is in transportation mode.

As reflected in FIGS. 7 and 12, when the portable metal crusher 1 is in transport mode, the stabilizers 55 will be in their fully retracted positions, the load door 100 will be in its fully up position, the side shields 65 will be folded against the load door 100 and the top deck 60 and the crush plate cylinders 225 will be recessed within the baling chamber 70 so that the crush plate is supported by removable supports 246.

Next, as shown in FIG. 1, the stabilizers 55 will be fully extended to support the portable metal crusher 1 after which the semi-tractor 245 may be detached. The side shields 65 are then unfolded to their full open positions and secured in place by the attachment rods 215. The load door 100 is then fully lowered. Now the interior of the baling chamber is visible and appears as reflected in FIG. 12.

Figure 13:
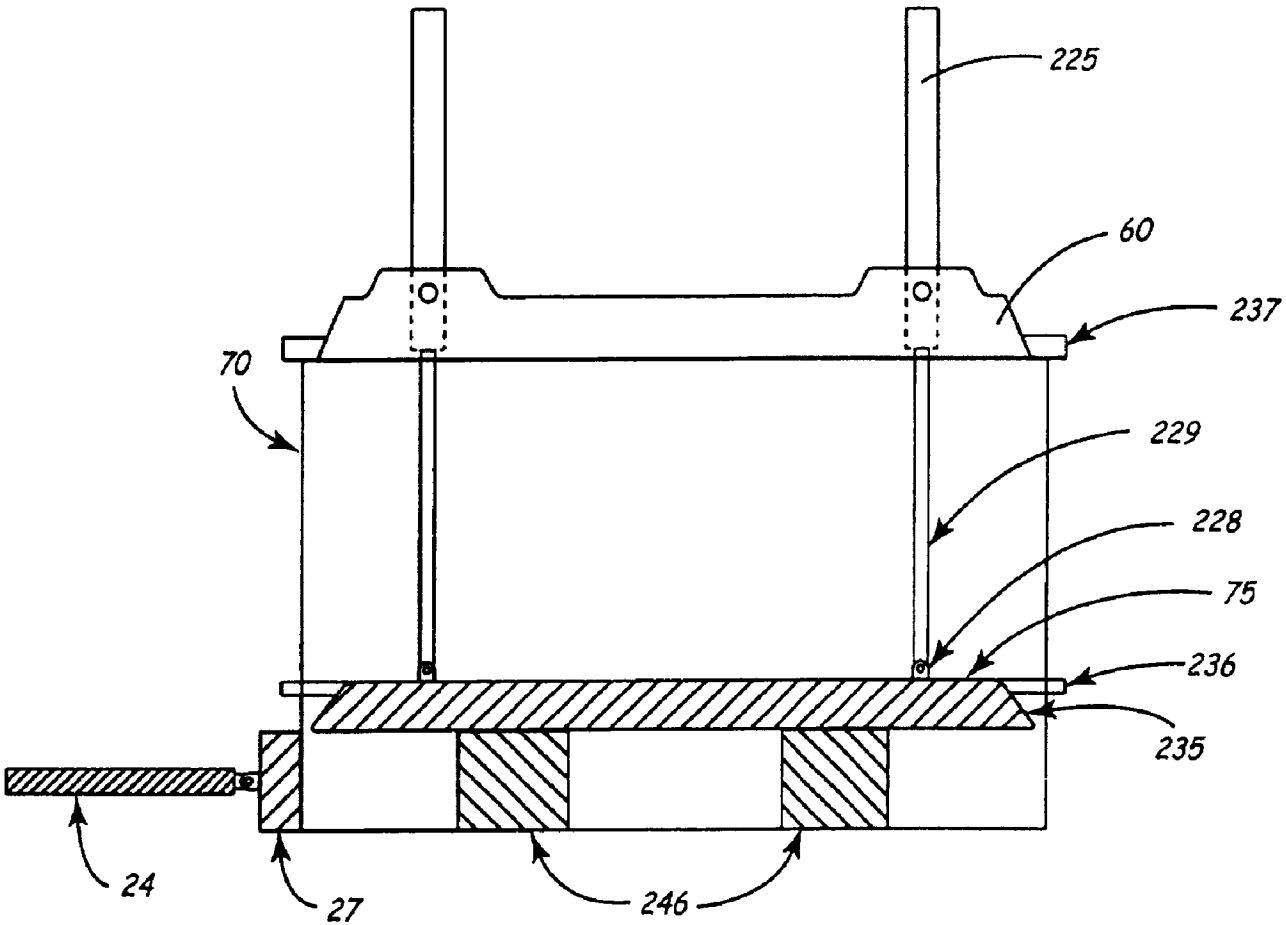
FIG. 13 is a simplified elevation side view of the baler portion of FIG. 12 where the crush plate cylinders have been used to raise the top deck up where it is secured to the fore and aft wall peaks, the crush plate continuing to rest on the support stands.

As illustrated in FIG. 13, the crush plate 75 is still supported by removable supports 246. The vertical pistons 229 of the crush plate cylinders 225 press against the crush plate 75 and raise the top deck 60 to its fully up, operational position at the top of the baling chamber 70. As the top deck 60 rises, the top deck goosenecks 237 slide within the guide slots 120, ensuring that the displacement of the top deck 60 is strictly vertical.

As shown in FIG. 11, as the top deck 60 nears its fully up operational position, the guide pins 244 will penetrate the guide holes 243, thereby ensuring proper alignment for insertion of the peak pins 240. Once the top deck 60 is in its fully up operational position with the guide pins 244 properly located within the guide holes 243, the upward displacement of the top deck 60 will be arrested because the top of the top deck 60 will encounter the bottom of the horizontal plates 242. The peak pins 240 are now inserted into the pin holes 239 by hand or by using the push pin 241. The peak pins 240 rest in the saddles 238 located on top of each wall peak 122, 123. The top deck 60 is now supported by and secured to the walls 80, 85 (see FIGS. 1,10 and 11).

The vertical pistons 229 are then retracted, bringing the crush plate 75 up to the bottom of the top deck 60. As the crush plate 75 rises, the crush plate goosenecks 236 slide within the guide slots 120, ensuring that the displacement of the crush plate 75 is strictly vertical. The removable supports 246 are then removed. The baling chamber 70 is now configured as illustrated in FIG. 14. The portable metal crusher 1 has now been fully converted from transportation to operation mode and appears as indicated in FIG. 1. The portable metal crusher 1 is now ready to bale scrap metal. To convert the portable metal crusher 1 back to transportation mode, the above steps are reversed.

Figure 15:
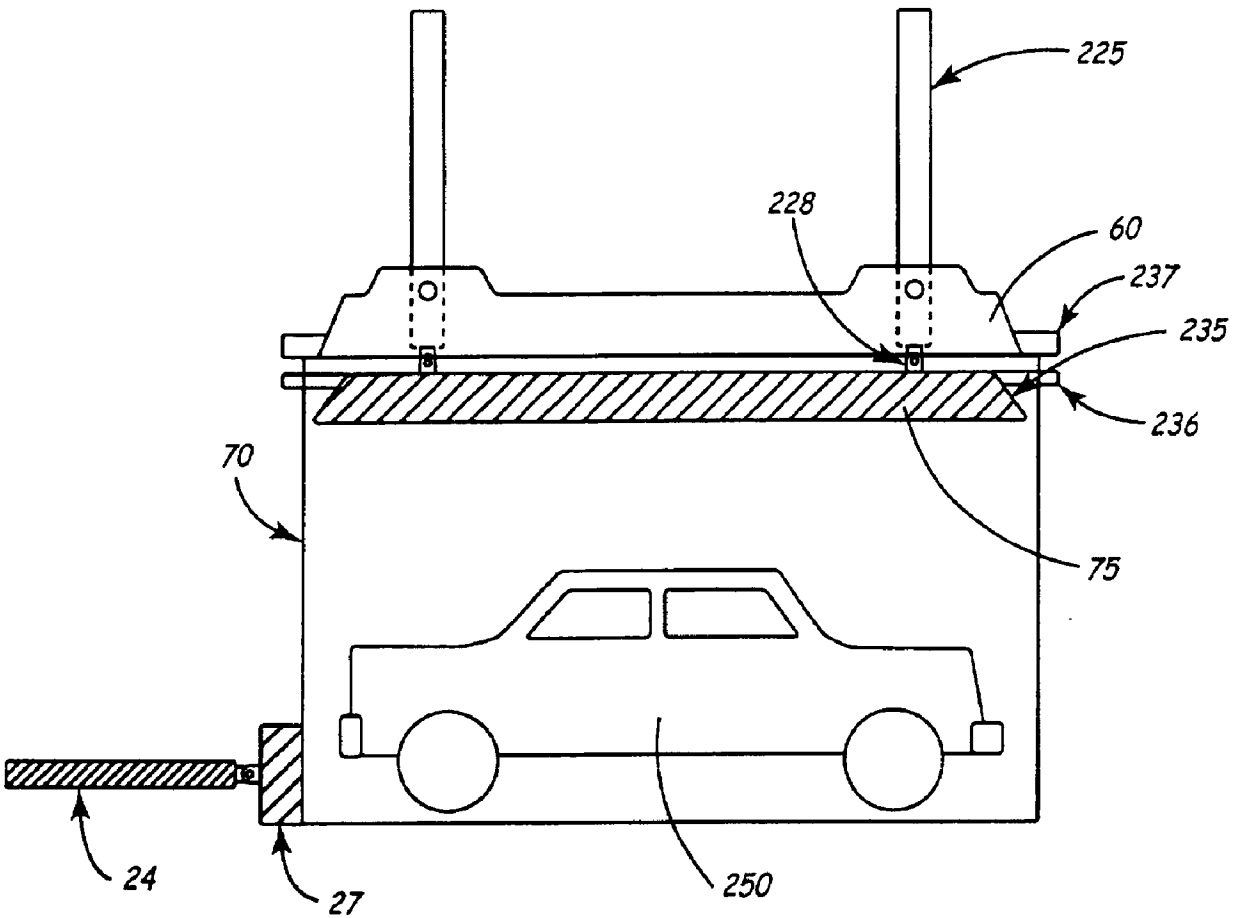
FIG. 15 is a simplified side elevation view of the baler portion of the portable metal crusher with the load door removed showing the starting positions of the crush plate, the plunger, and the newly loaded automobile when the portable metal crusher is in operation mode.
Figure 16:
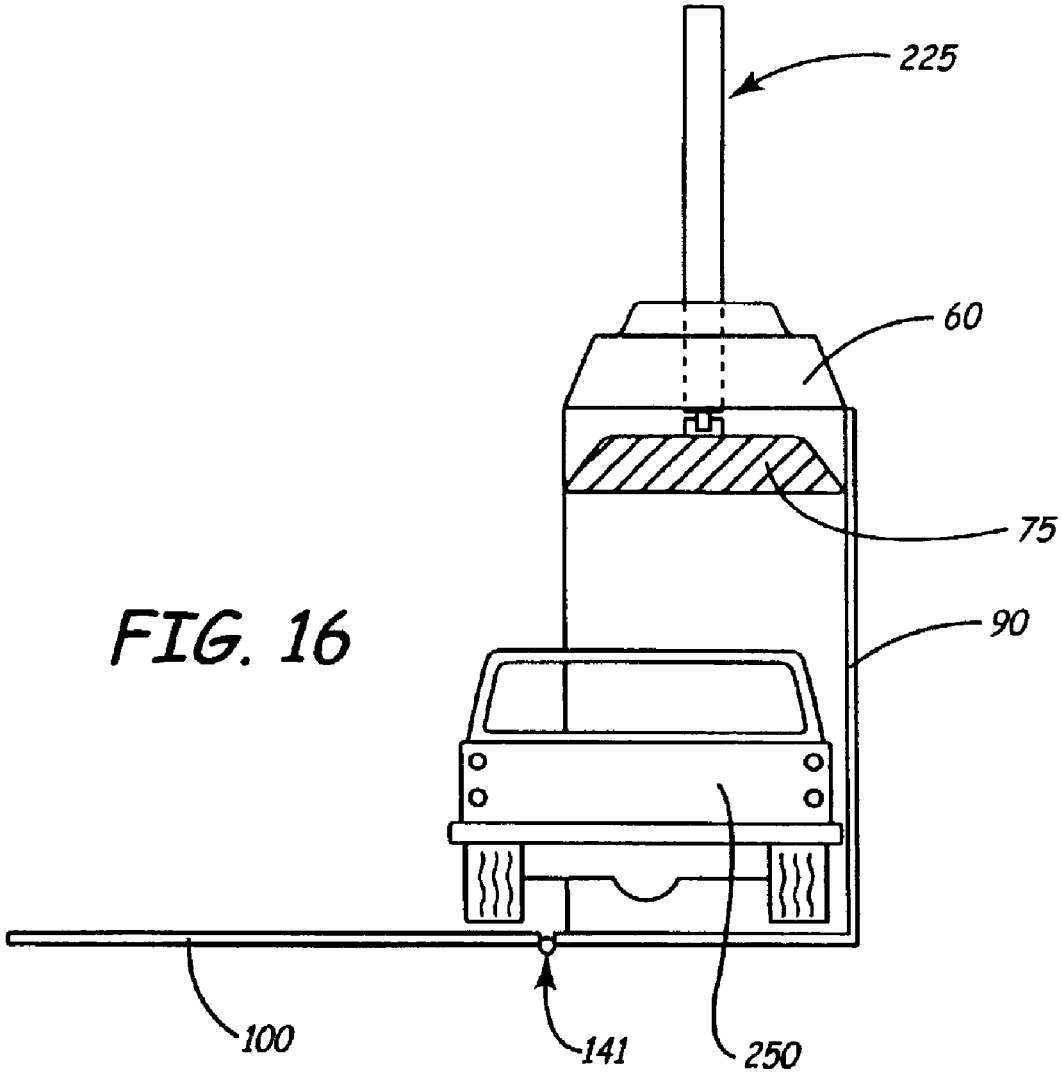
FIG. 16 is a simplified elevation end view of the baler portion of the portable metal crusher showing the load door in its fully down position, the crush plate and the plunger in their fully retracted positions, and the newly loaded automobile when the portable metal crusher is in operation mode.

To illustrate the operation of the portable metal crusher 1, FIGS. 6, 8, 14, 15, 16, 17, 18 and 19 will be addressed. With the portable metal crusher 1 configured as illustrated in FIG. 1 and 14, an automobile 250 (or other scrap) is loaded into the baling chamber 70 by a front-end loader, forklift, skidder or crane. The loaded baling chamber now appears as shown in FIGS. 15 and 16. Alternatively, if loose scrap is to be loaded into the baling chamber 70, the load door 100 may be positioned to form a hopper as reflected in FIG. 8.

Figure 17:
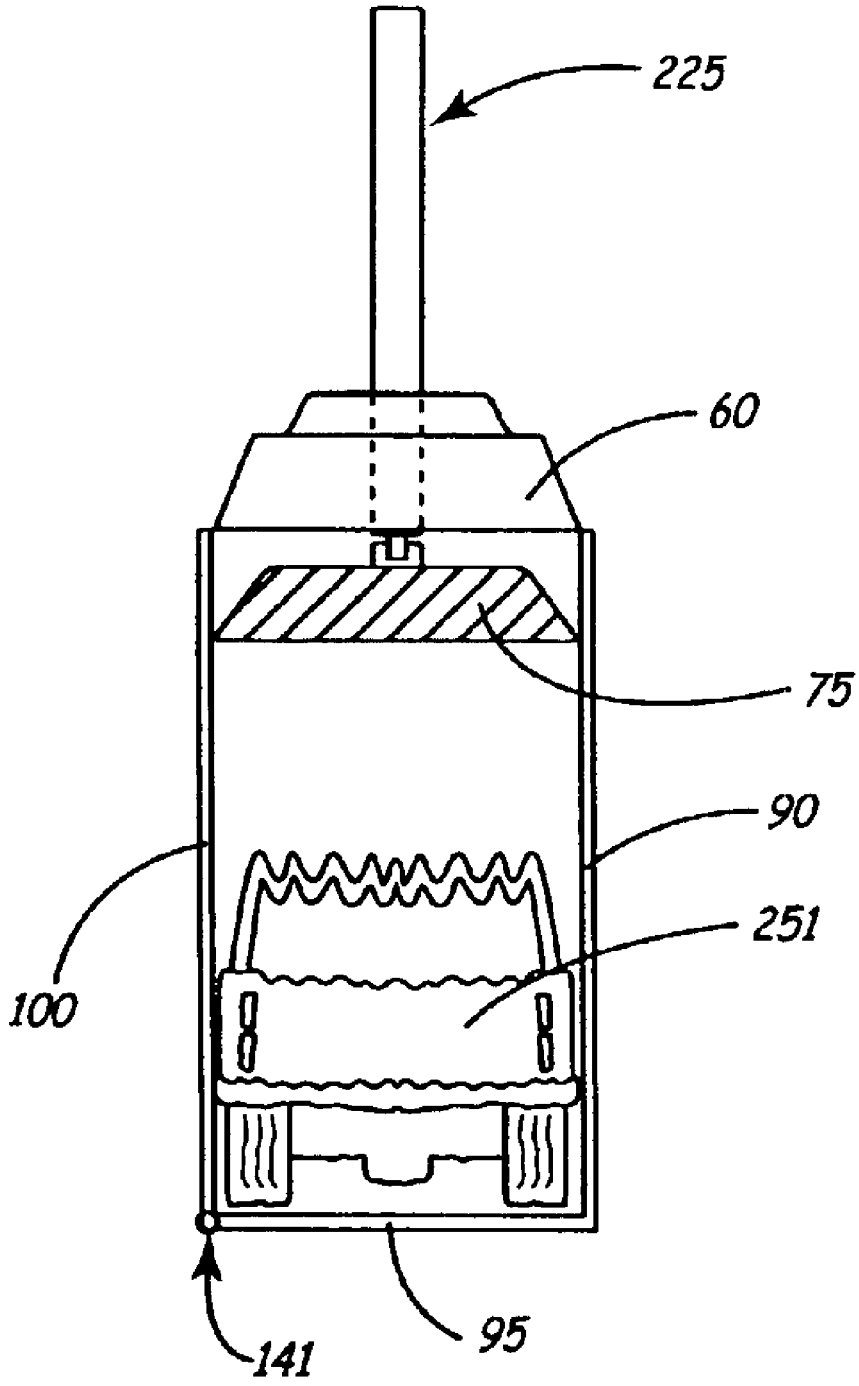
FIG. 17 is the same view indicated in FIG. 16 except the load door has been fully closed, crushing the automobile in the lateral axis.

Once the baling chamber 70 has been loaded with an automobile 250 and/or loose scrap metal, the first crushing stage can occur. The door cylinders 205 will pivot the arm rotators 180, causing the arms 160, 165 to retract. The retracting arms 160, 165 will cause the load door 100 to pivot about its system of hinges 141 to the fully closed position, forcing the load door 100 against the automobile 250, reducing it to a crushed automobile 251 in the lateral axis as illustrated in FIGS. 6 and 17. In one embodiment, the load door 100 is configured to create a crushed automobile 251 having a four foot lateral dimension.

Figure 18:
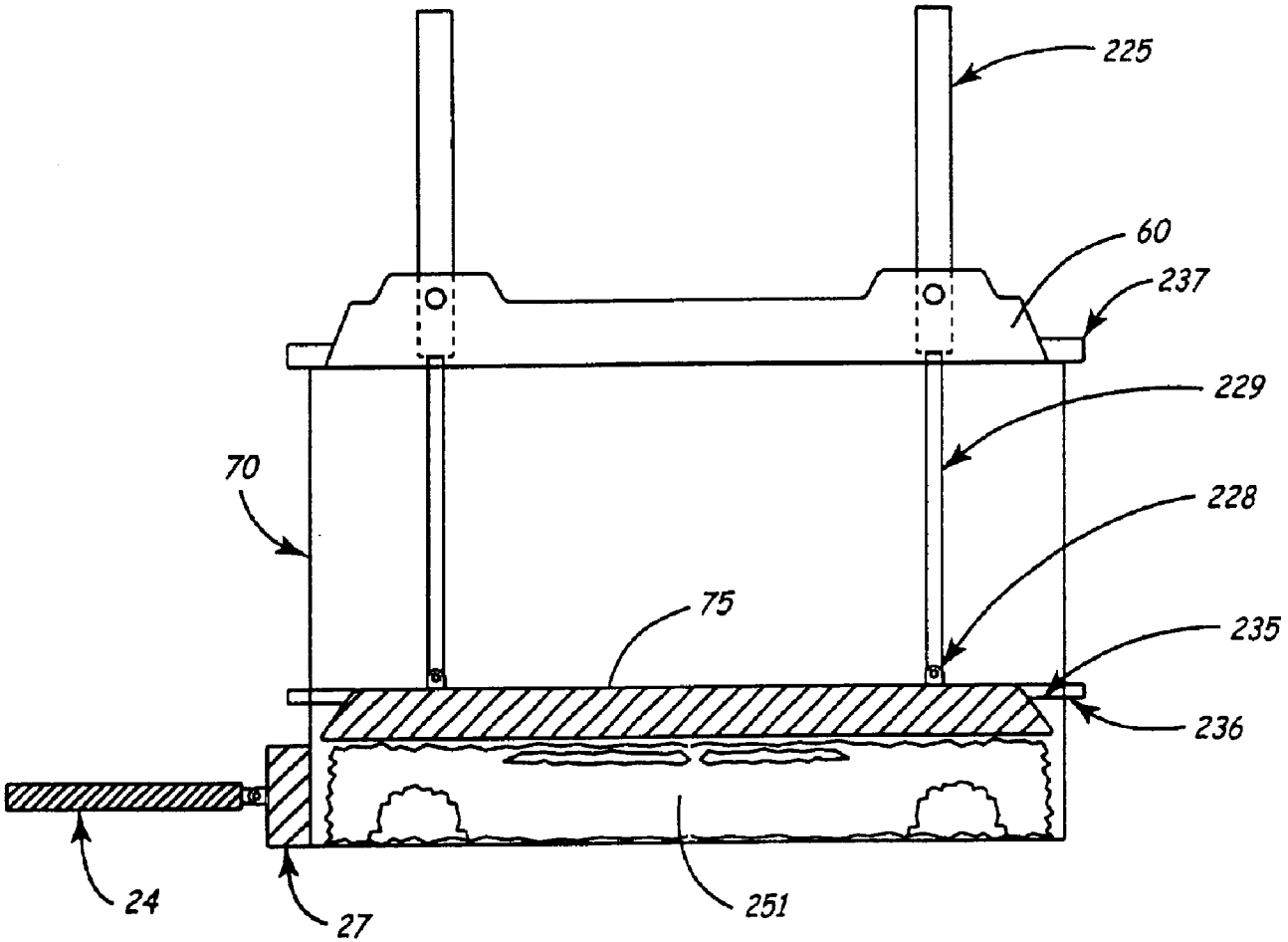
FIG. 18 is the same view indicated in FIG. 15 except the crush plate has been actuated, crushing the automobile in the vertical axis.

The second crushing stage is then employed. As shown in FIG. 18, the vertical pistons 229 force the crush plate 75 down against the crushed automobile 251, crushing it in the vertical axis. In one embodiment, this second crushing stage reduces the crushed automobile 251 to a height of two feet.

Figure 19:
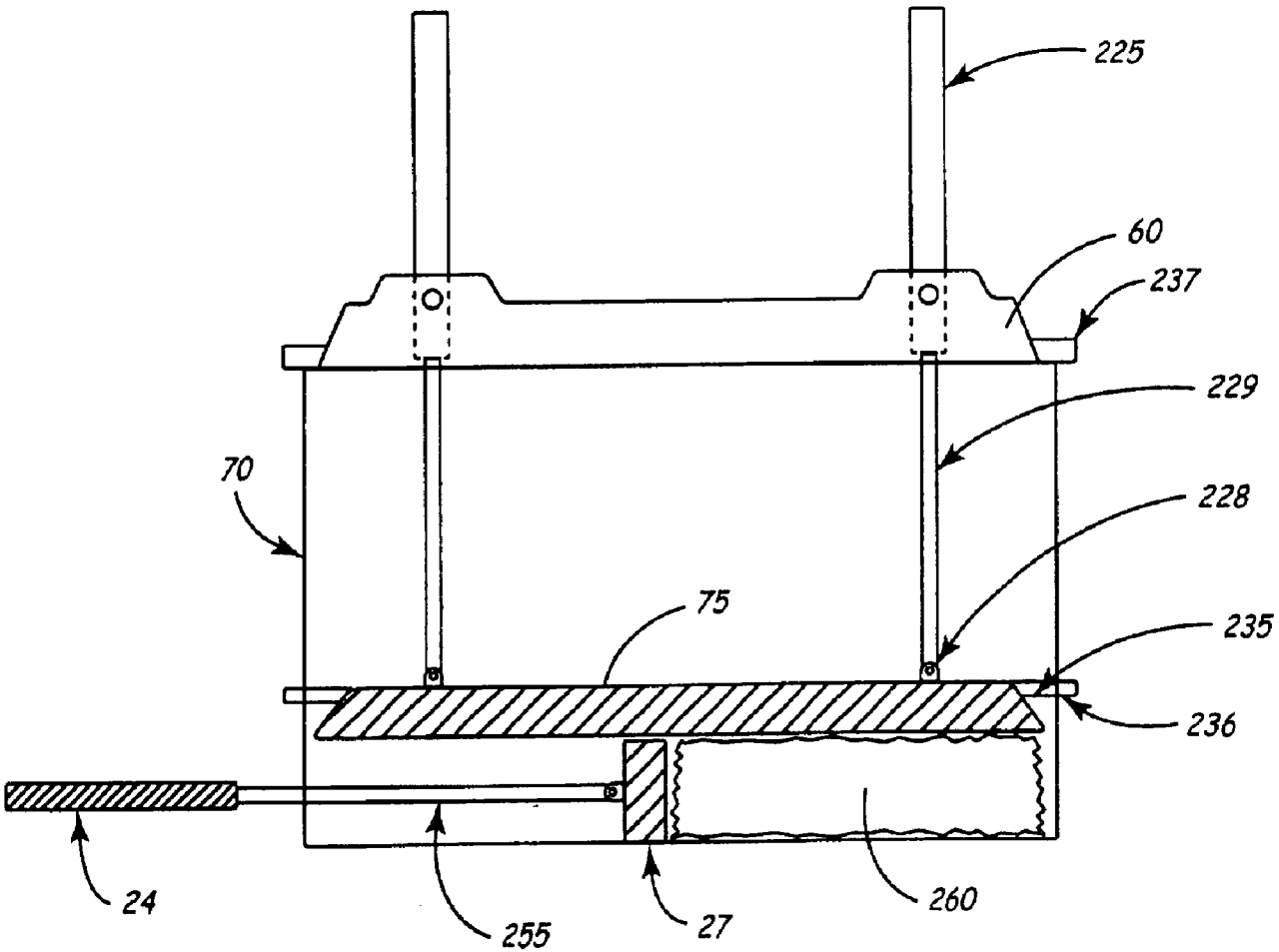
FIG. 19 is the same view indicated in FIG. 18 except the plunger has actuated in the longitudinal axis, reducing the crushed automobile to a bale.

In one embodiment, a third crushing stage then takes place with the plunger pistons 255 forcing the plunger 27 in the longitudinal axis against the crushed automobile 251 forming a bale 260 (see FIG. 19). In one embodiment, the third crushing stage reduces the length of the crushed automobile to twelve feet. In another embodiment, the final length of the crushed automobile 251 (or loose scrap), is dependent upon the pressure within the hydraulic cylinder and within the baling chamber 70. The plunger 27 and crush plate 75 then return to their starting positions as reflected in FIG. 14, the load door 100 opens to its fully down position as shown in FIG. 1, and the bale 260 is removed by a front-end loader, forklift, skidder or crane. The portable metal crusher 1 is now ready to process another load of scrap metal.

The portable metal crusher 1 is fully controllable from the control valve manifold 42 or from the control panel 43 (see FIG. 1). The portable metal crusher is also fully controllable from a hand held remote control 261, which utilizes any form of wireless communication such as radio frequency, infra-red, or any other technique known in the art, to communicate with the control panel 43 mounted on the gooseneck 9 of the portable metal crusher 1.

The portable metal crusher 1 is fully automated. For example, by pressing a single button on the control panel 43 or the remote control 261, the crush plate 75 and the plunger 27 will return to their retracted positions as reflected in FIGS. 1, 14 and 15, and the load door 100 will fully open. By pressing another button, the three stage crushing cycle will begin as narrated above and reflected in FIGS. 17, 18 and 19. Pressing yet another button will stop the portable metal crusher 1 in any cycle. The portable metal crusher 1 may be programmed to exert different crush pressures, thereby being capable of producing bales of different densities. Also, the portable metal crusher 1 may be programmed to produce bales of varying length. The above-programmed operations are given as examples only and other operations may be programmed.

Although the present invention has been described with reference to preferred embodiments, persons skilled in the art will recognize that changes may be made in form and detail without departing from the spirit and scope of the invention.

I claim:

1. A mobile metal crusher capable of forming scrap metal bales by crushing automobiles or scrap metal latitudinally, vertically, and longitudinally, the crusher comprising:

a frame having wheels to facilitate the transport of the mobile metal crusher; and a baling chamber rigidly attached to the frame and including a bottom deck, a load door, a crush plate, and a wall;

wherein the load door has a first end that is pivotally connected to the bottom deck and is adapted to crush the scrap metal latitudinally as the load door pivots from an open position to a closed position;

wherein the crush plate is located above the bottom deck, operatively connected to the frame, and adapted to crush the scrap metal vertically as the crush plate is displaced vertically within the baling chamber; and wherein the wall has a first end rigidly connected to the bottom deck and includes a plunger adapted to crush the scrap metal longitudinally as the plunger is displaced horizontally within the baling chamber.

2. The mobile metal crusher of claim 1 wherein the baling chamber further comprises a side shield pivotally connected to the wall, wherein the load door and the side shield form a hopper for receiving the scrap metal when the side shield is pivoted out to its fully extended position and the load door is disposed at an intermediate position.

3. The mobile metal crusher of claim 1 wherein the load door, when in its fully open position, lies nearly flat on the ground, such that the upper surfaces of the load door and the bottom deck form an essentially level contiguous surface.

4. The mobile metal crusher of claim 1 further comprising a crush plate cylinder and a top deck having a cylinder mount, the crush plate cylinder being secured to the cylinder mount and being used for displacing the crush plate vertically within the baling chamber.

5. The mobile metal crusher of claim 4 wherein the wall further comprises a peak and the top deck further comprises a securing end, the securing end being releaseably secured to the peak so that the top deck and the crush plate cylinder may be lowered into the baling chamber upon the securing end being released from the peak.

6. The mobile metal crusher of claim 5 wherein the wall further comprises a guide slot adapted to receive and guide the securing end, such that the securing end may translate only vertically.

7. The mobile metal crusher of claim 5 wherein the peak further comprises a horizontal plate and a saddle, the securing end further comprising a pin hole and a guide pin, the horizontal plate having a guide hole for receiving the guide pin, the saddle and pin hole being for receiving a peak pin.

8. The mobile metal crusher of claim 1 further comprising a plunger cylinder, the plunger cylinder being located within the frame and being used for displacing the plunger horizontally within the baling chamber.

9. The mobile metal crusher of claim 1 further comprising an arm rotator, the arm rotator being pivotally mounted on an exterior surface of the baling chamber and being pivotally connected to a door cylinder, the door cylinder causing the arm rotator to rotate thereby causing the load door to pivot.

10. A method of forming scrap metal bales by crushing automobiles or scrap metal latitudinally, vertically, and longitudinally, the steps of the method comprising:

loading a baling chamber with the metal to be crushed;

pivoting a load door up to its fully closed position to crush the metal latitudinally;

vertically displacing a crush plate within the baling chamber to crush the metal vertically; and horizontally displacing a plunger within the baling chamber to crush the metal longitudinally.

11. The method of claim 10 further comprising forming a hopper for receiving the scrap metal by extending a side shield and disposing the load door at an intermediate position.

12. The method of claim 10 further comprising, prior to the loading step, opening the load door to about flat on the ground, such that an upper surface of the load door and a bottom deck of the baling chamber form an essentially level contiguous surface.

13. The method of claim 10 wherein the crush plate is vertically displaced by supplying hydraulic fluid to a crush plate cylinder.

14. The method of claim 13 wherein the vertically displacing step further includes guiding the crush plate, such that the crush plate may translate only vertically.

15. The method of claim 10 wherein the plunger is displaced by supplying hydraulic fluid to a plunger cylinder.

16. The method of claim 10 wherein the load door is closed using an arm rotator that is pivotally mounted on an exterior surface of the baling chamber and is pivotally connected to a door cylinder.

17. A mobile metal crusher for forming scrap metal bales, the crusher comprising:

a baling chamber rigidly attached to a frame and including a bottom deck, a load door, a plunger and a crush plate;

wherein the load door has a first end that is pivotally connected to the bottom deck and is adapted to crush the scrap metal latitudinally as the load door pivots from an open position to a closed position;

wherein the crush plate is located above the bottom deck, operatively connected to the frame, and adapted to crush the scrap metal vertically as the crush plate is displaced vertically within the baling chamber; and wherein the plunger has a face generally perpendicular to the bottom deck and is adapted to crush scrap metal longitudinally as the plunger displaces horizontally along the deck within the baling chamber.

18. The crusher of claim 17 further comprising a frame having wheels to facilitate the transport of the mobile metal crusher.

19. The crusher of claim 17 wherein the plunger and the crush plate are displaced via hydraulic cylinders.

* * * * *